US006237911B1

(12) United States Patent
Mori et al.

(10) Patent No.: US 6,237,911 B1
(45) Date of Patent: May 29, 2001

(54) SHEET MATERIAL GUIDE

(75) Inventors: Yoshikazu Mori, Iruma-gun; Tadashi Hatamachi, Higashimatsuyama, both of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/331,360

(22) PCT Filed: Oct. 20, 1998

(86) PCT No.: PCT/JP98/04753

§ 371 Date: Jun. 18, 1999

§ 102(e) Date: Jun. 18, 1999

(87) PCT Pub. No.: WO99/20554

PCT Pub. Date: Apr. 29, 1999

(30) Foreign Application Priority Data

Oct. 21, 1997 (JP) ..... 9-288560

(51) Int. Cl.[7] ..... B65H 9/00

(52) U.S. Cl. ..... 271/239; 271/226; 271/234; 271/239; 271/240; 271/253

(58) Field of Search ..... 271/3.13, 3.15, 271/162, 171, 223, 225, 240, 253, 264, 272, 273, 274

(56) References Cited

FOREIGN PATENT DOCUMENTS 3-56328 3/1991 (JP) ..... B65H/3/00
6-135526 5/1994 (JP) ..... B65G/21/20

*Primary Examiner*—Donald P. Walsh
*Assistant Examiner*—Mark J. Beauchaine
(74) *Attorney, Agent, or Firm*—Hogan &Hartson, LLP

(57) ABSTRACT

A sheet material guide (1) for guiding banknotes as a sheet material to a banknote processor used for service machines such as an automatic vending machine, an exchanging machine, pachinko ball dispensing machine and a medal dispensing machine, wherein a banknote conveying path width changing device (21) comprises and arm (22) disposed in the banknote conveying direction and having both ends thereof rotatable supported on the side of an upper chute (8) and a guide rotor (27) rotatably supported at an intermediate portion (22*c*) of the arm (22) in the banknote conveying direction of the arm (22) and having a plurality of sheet plates (23) having mutually different widths and radially disposed in the banknote conveying direction, and when one of the sheet plates (23) of the guide rotor (27) is disposed between the upper and lower chutes (8, 2), the side (23*b*) of the sheet plate (23) defines the side surface of a banknote conveying path (12), thereby changing the width of the banknote conveying path in multiple stages by a simply operation.

7 Claims, 3 Drawing Sheets

SHEET MATERIAL GUIDE

TECHNICAL FIELD

The present invention relates to a sheet material guide for guiding sheets of different width, and more particularly, to an improved sheet guide for guiding a banknote, into a banknote processing apparatus for use in a service machine such as a vending machine, a money changing machine, a pinball dispenser or a token dispenser.

BACKGROUND ART

In general, a banknote processing apparatus for determining the authenticity of a banknote, inserted therein and accepting a genuine one, is installed in a service machine such as a vending machine, a money changing machine, a pinball dispenser or a token dispenser, and a sheet guide forms a portion of this banknote processing apparatus.

Furthermore, as an example of an application of this kind of sheet guide, in addition to the apparatus for guiding a banknote described above, there is also an apparatus for guiding a card, into a card processing apparatus which guides an inserted card along a card passageway, and during which time, reads and writes information on various storage areas formed on the card.

Meanwhile, this kind of sheet guide ordinarily comprises a banknote conveying path provided inside a main body, and a banknote conveying path width varying means for changing the width of the banknote conveying path in a plurality of stages.

The banknote conveying path width varying means, as disclosed in Unexamined Japanese patent publication Kokai No. 9-16826, for example, comprises a mating groove, which is formed parallel to the banknote conveying path in the side of the banknote conveying path, and mating members, which are formed parallel to banknote conveying path, and which mate to the mating groove in a freely detachable manner. By attaching different shaped mating members to the mating groove, it is possible to change the width of the banknote conveying path.

With the sheet guide of the aforementioned type, by providing a plurality of mating members, the shapes of which differ in accordance with the width of a sheet, selecting the one mating member among those that correspond to the width of the sheet to be conveyed, and mating it to the mating groove, it is possible to change the width of the banknote conveying path so that it corresponds to the width of the sheet, without replacing the entire sheet guide.

In particular, when a sheet guide is utilized in a banknote processing apparatus, it is possible to change the width of the banknote conveying path so that it corresponds to the different widths of paper currency from countries around the world, without replacing the entire sheet guide.

However, in accordance with the conventional sheet guide described above, the banknote conveying path width varying means comprises a mating groove, which is formed in the side of the banknote conveying path, and mating members, which mate to the mating groove in a freely detachable manner. When changing the width of the banknote conveying path, it is necessary to perform the work, first, of preparing a new mating member with a shape that corresponds to the width of the sheet, next, of removing the mating member that is attached to the mating groove, and then, of attaching the new mating member to the sheet material guide. Consequently, the job of changing the width of the banknote conveying path has the drawback of being complicated and troublesome.

Therefore, an object of the present invention is to provide a sheet guide, which does not have the drawback of conventional sheet guide such as above, and which is capable of changing the width of a banknote conveying path using a simple operation in a plurality of stages.

DISCLOSURE OF THE INVENTION

The present invention is a sheet guide having a banknote conveying path, upper and lower surfaces thereof being formed by a lower chute and an upper chute; a banknote insertion opening, which communicates with the banknote conveying path; and banknote conveying path width varying means provided on the side of at least one of the upper and lower chutes, for changing width of the banknote conveying path in a plurality of stages, characterized in that the banknote conveying path width varying means comprises an arm provided parallel to a direction of travel of a sheet, both ends thereof being supported in a freely rotatable manner at a side portion of the shoot; and a guide rotor supported in a freely rotatable manner by an intermediate portion of the arm, the intermediate portion paralleling the direction of travel of the sheet, and formed with a plurality of sheet plates provided radially and having differing widths that parallel the direction of travel of the sheet, wherein when one of the plurality of sheet plates of the guide rotor is provided between the upper and lower chutes, sides of the sheet plate form sides of the banknote conveying path.

The sheet guide configured in the above manner enables the width of the banknote conveying path to be changed in a plurality of stages by the simple operation of selecting one of the plurality of sheet plates that constitute the guide rotor, which in turn simplifies the job of changing the width of the banknote conveying path in a vending machine, a money changing machine, a pinball dispenser a medal dispenser, or other service machine that makes use of the sheet guide of the present invention, thus enabling the efficiency of maintenance, inspection and other work to be further enhanced.

BEST MODE FOR CARRYING OUT THE INVENTION

The present invention is explained in more detail by reference to the attached drawings.

A sheet guide employed in a banknote processing apparatus is explained below as an embodiment of a sheet guide according to the present invention.

Figure 1:
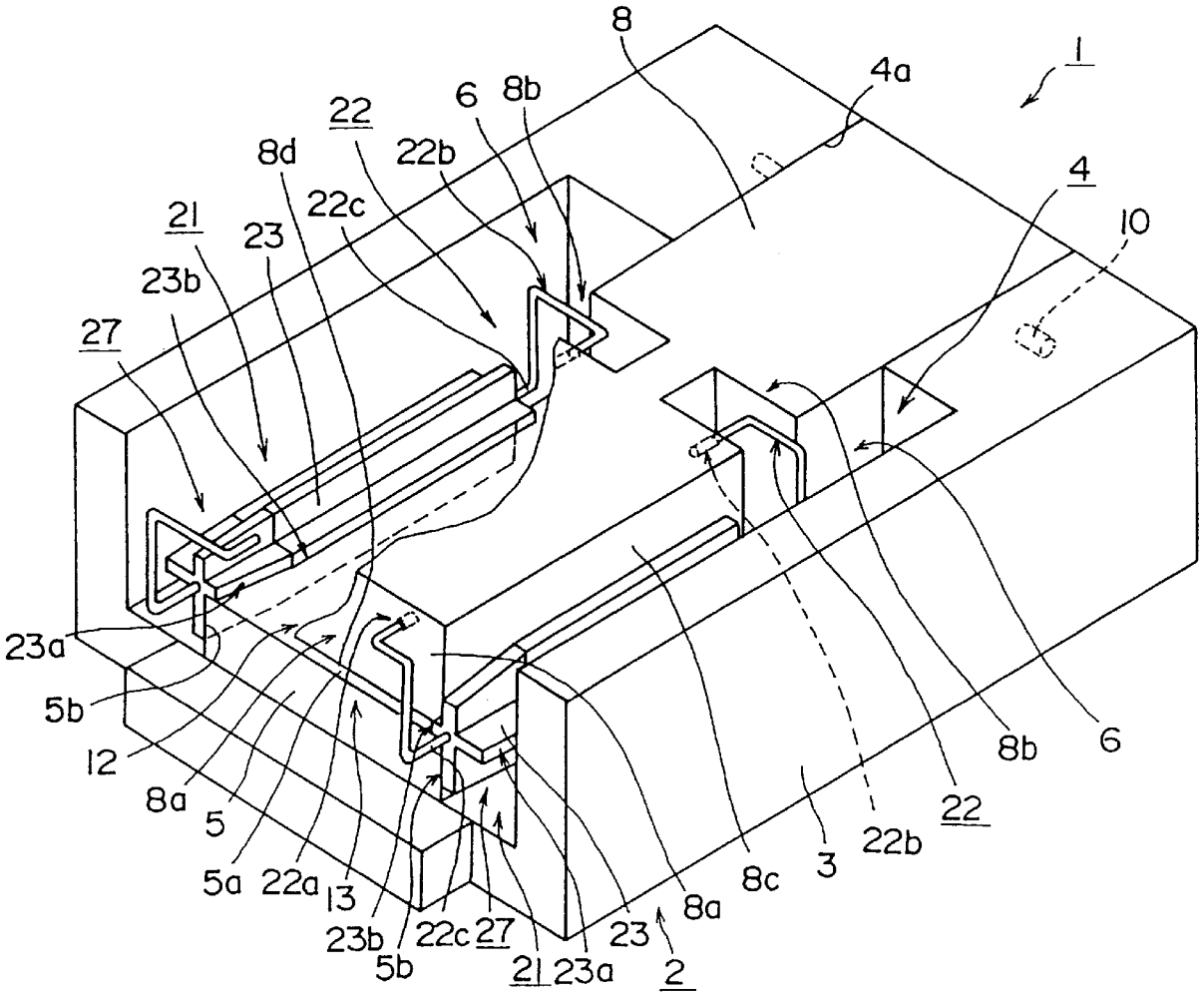
FIG. 1 is a schematic perspective partially cutaway view of essential portion of a sheet guide of the present invention.

FIG. 1 is a schematic perspective partially cutaway view of essential portion of a sheet guide 1 of the present invention.

Figure 3:
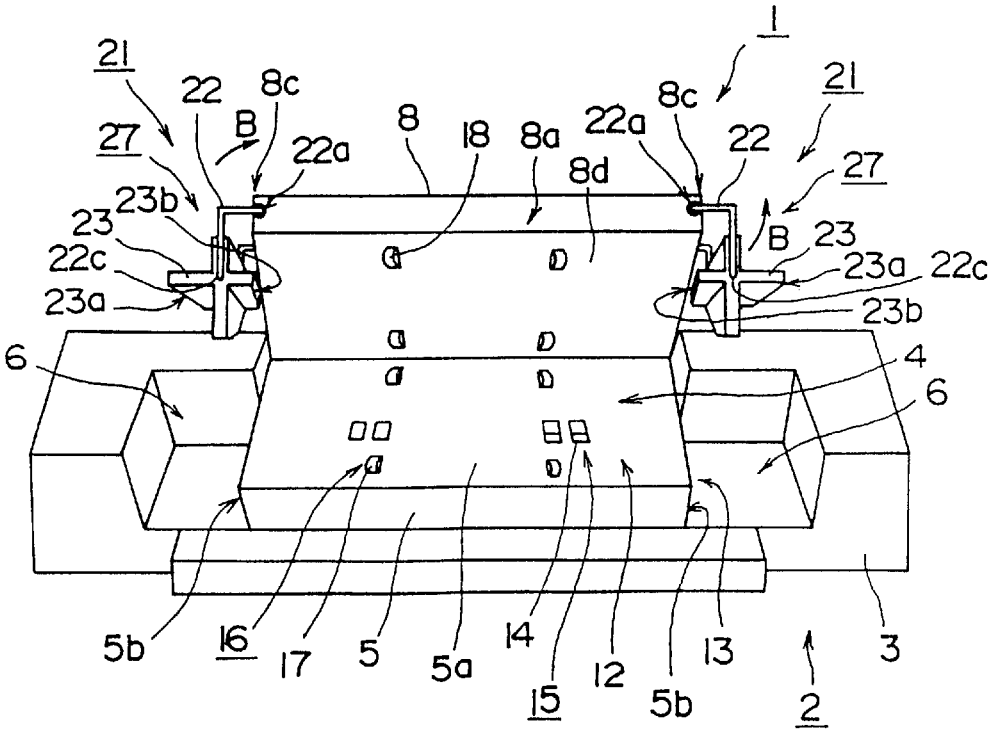
FIG. 3 is a schematic perspective view showing the operation of the banknote conveying path width varying means in which the banknote insertion opening is opened by rotating the upper chute upward about a shaft.

The sheet guide 1 of this invention comprises a lower chute 2 which comprises a housing 3 which is U-shaped in cross-section, an upper chute 8 which is rectangular in cross-section and is supported by the lower chute 2 in a freely rotatable manner, a banknote conveying path 12 whose lower and upper surfaces are defined by the lower chute 2 and upper chute 8, a banknote insertion opening 13 which communicates with the upstream portion of the banknote conveying path 12, banknote conveying path width changing means 21 which are provided on both sides of the upper chute 8 and change the width of the banknote conveying path 12 in a plurality of stages, and as shown in FIG. 3 which depicts the upper chute 8 in open state, identifying means 15 which is provided in the banknote conveying path 12 and comprises a photosensor 14 for judging the authenticity of the banknote, and conveying means 16 which comprises a conveyor roller 17 and conveys a banknote inserted via the banknote insertion opening 13 along the banknote conveying path 12 to the downstream portion thereof.

Incidentally, a banknote determined to be genuine by the identifying means 15 of the sheet guide 1 is stored in a stacker not shown in the figure.

As shown in FIG. 1, the housing 3 of the lower chute 2 is formed with an insertion groove 4, into which the upper chute 8 is inserted and is supported in a freely rotatable manner by a shaft 10 which is inserted into both sides of a groove 4*a* which is formed in a downstream portion of the banknote conveying path 12.

Further, as shown in FIG. 3, a plate member 5, which is in a rectangular shape in cross-section and the width of which is narrower than the width of the insertion groove 4, is mounted parallel to the banknote conveying path 12 on the upper surface of the insertion groove 4 of the housing 3. The plate member 5 has an upper surface 5*a* which forms the lower surface of the banknote conveying path 12, and two sides 5*b* which form, together with the side walls of the insertion groove 4, housing grooves 6 in which respective banknote conveying path width changing means 21 are housed.

The banknote conveying path width changing means 21 comprises a pair of arms 22, which are L-shaped viewed from the front and U-shaped viewed from the top and are provided in parallel to the direction of travel of the banknote and which are supported in a freely rotatable manner at the sides of the upper chute 8; and a guide rotor 27, which is supported in a freely rotatable manner by an intermediate portion 22*c* of these pair of arms 22, paralleling the direction of travel of the banknote, and which comprises 4 radially extended sheet plates 23 of different widths running parallel to the direction of travel of the banknote.

In the banknote conveying path width changing means 21, as shown in FIG. 1, one of the sheet plates 23 constituting the guide rotor 27 makes contact with the upper surface 5*a* of the plate member 5, and one of the other sheet plates 23, which forms a right angle with the sheet plate 23 that contacts with the upper surface 5 makes contact with the side 5*b* of the plate member 5.

The upper chute 8 has a front face 8*a* and two sides 8*c*. The front face 8*a* supports one end 22*a* of the arms 22 on both sides. In the two sides 8*c*, notches 8*b*, which support the other end 22*b* of the arms 22, are respectively formed in the downstream portion of the banknote conveying path 12. The two sides 8*c* of the upper chute 8 are inserted into the insertion groove 4 of the lower chute 2 as depicted in FIG. 1.

The upper chute 8 is supported and positioned with a prescribed space between the upper and lower chutes by latch means (not shown) which is disposed therebetween as depicted in FIG. 1, as a result of which the upper surface of the banknote conveying path 12 is formed by a lower surface 8*d* of the upper chute 8. Furthermore, between the upper chute 8 and the lower chute 2 are disposed positioning means (not shown), which supports the upper chute 8, when it rotates upward around the shaft 10 to a prescribed angle.

Next, the structure of banknote conveying path width changing means 21, which are provided, respectively, on both the right and left sides of the upper chute 8, are explained in detail. Since these banknote conveying path width changing means 21 feature the same structure, the explanation focuses only on the banknote conveying path width changing means 21 provided on the right side of the upper chute 8.

The banknote conveying path width changing means 21 comprises a pair of arms 22 provided parallel to the direction of travel of the banknote and are supported in a freely rotatable manner by the right side of the upper chute 8, and a guide rotor 27 supported in a freely rotatable manner by an intermediate portion 22*c* of the pair of arms 22, paralleling the direction of travel of the banknote and formed from after sheet plates 23 radially provided, having different widths and running parallel to the direction of travel of the banknote.

Of these elements, the arm 22 is formed from one end 22*a*, which is supported by the right side of the front face 8*a* of the upper chute 8, from another end 22*b*, which is supported by a notch 8*b* in the right side of the upper chute 8, and from an intermediate portion 22*c*, which is formed parallel to the direction of travel of the banknote, and which supports in a freely rotatable manner the guide rotor 27, and is attached in a freely detachable manner to the upper chute 8 by the one end 22*a* and the other end 22*b* thereof.

Further, as for the guide rotor 27, the four sheet plates 23 are integrated together, each sheet plate 23 forms the same angle with the other, that is, a 90 degree angle, and the thickness of each sheet plate 23 is the same.

These four sheet plates 23 are formed with inclined surfaces 23*a* on the sides 23*b* of the sheet plates 23, so that the respective widths thereof become narrower towards the banknote insertion opening 13.

Figure 2:
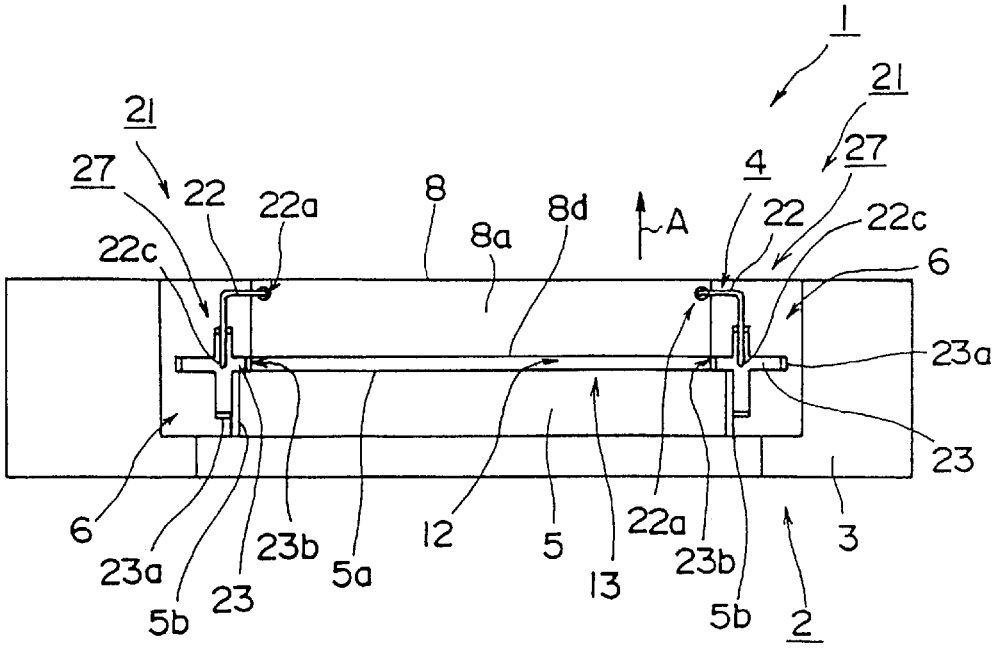
FIG. 2 is a schematic front view showing the banknote conveying path width varying means in normal operation.

As depicted in FIG. 2, the banknote conveying path width varying means 21 is provided inside the housing groove 6 so that one of the four sheet plates 23 of the guide rotor 27 makes contact with the upper and lower shoots 8, 2. Further, the respective sides of the banknote conveying path 12 are formed by the sides 23*b* of the sheet plates 23 located between the upper and lower chutes 8, 2.

The thickness of the sheet plate 23 that is making contact with the upper and lower chutes 8, 2 constitutes the height of the banknote conveying path 12.

The conveying means 16 shown in FIG. 3 comprises a conveyor roller 17, which is supported in a freely rotatable manner by the plate member 5, and which has a portion of its contact surface exposed in the banknote conveying path 12, a not-shown insertion sensor, which detects whether or not a banknote has been inserted into the banknote insertion opening 13, a not-shown drive motor, which drives the conveyor roller 17 on the basis of the detection of this insertion sensor, and an idle roller 18, which is supported in a freely rotatable manner by the upper chute 8, and which has a portion of its contact surface exposed in the banknote conveying path 12. The idle roller 18 functions as a driven roller, which rotates in the opposite direction of the conveyor roller 17.

In accordance with the sheet guide 1 such as this, when a banknote is inserted into the banknote insertion opening 13, and this is detected by the insertion sensor, the drive motor of the conveying means 16 operates, and drives the conveyor roller 17 so that it rotates.

By driving and rotating the conveyor roller 17, the inserted banknote is sandwiched between the conveyor roller 17 and idle roller 18 of the conveying means 16, and is conveyed downstream parallel to the banknote conveying path 12. Following that, the authenticity of the banknote is determined by the identifying means 15, and when it is determined to be a counterfeit, the drive motor operates in reverse, rotating the conveyor roller 17 in the opposite direction, and returning the inserted banknote, which was determined to be a counterfeit, back through the banknote insertion opening 13.

When the inserted banknote is determined to be a genuine one by the banknote identifying means 15, since the rotation of the conveyor roller 17 is maintained in the clockwise direction on the basis of the detection signal thereof, the banknote is conveyed further downstream in the banknote conveying path 12, and accommodated inside a stacker.

With the sheet guide 1, because the 4 sheet plates 23, which constitute the guide rotor 27 of the banknote conveying path width changing means 21, are formed with inclined surfaces 23*a* so that the respective widths thereof become narrower towards the banknote insertion opening 13, as shown in FIG. 1, which depicts the initial position, the width of the banknote conveying path 12 becomes wider towards the banknote insertion opening 13, enabling banknote inserted through the banknote insertion opening 13 to be readily guided into the banknote conveying path 12.

Further, with the sheet guide 1, because the guide rotor 27 of the banknote conveying path width changing means 21 is formed by integrating together the four sheet plates 23, which form 90 degree angles with one another, in the initial position shown in FIG. 1, the upper surface 5*a* the plate member 5 can make contact with one of the sheet plates 23 of the guide rotor 27, and both sides 5*b* can make contact with one of the other sheet plates 23, which forms a right angle with the sheet plate 23. Furthermore, when a sheet plate 23 is positioned between the upper and lower chutes 8, 2, because it makes contact with and is sandwiched between the upper and lower chutes 8, 2, in the initial position shown in FIG. 1, the sheet plate 23 positioned between the upper and lower chutes 8, 2, can rotate around the intermediate portion 22*c* of the arm 22, or can prevent movement in the direction of the width of the banknote conveying path.

Therefore, the width of the banknote conveying path 12 is maintained constant, enabling the stable conveying of a banknote.

Next, the operation by which the width of the banknote conveying path 12 is changed by the banknote conveying path width changing means 21 is explained.

FIG. 2 through FIG. 5 are schematic views of a sheet guide 1, showing how the banknote conveying path width changing means 21 changes the width of the banknote conveying path 12. Elements that are the same as those in FIG. 1 are indicated using the same reference numerals.

In accordance with the banknote conveying path width changing means 21 of the above-described sheet guide 1, when the banknote conveying path width is to be changed, the latch means is released, as indicated by arrow A in FIG. 2, the upper chute 8 is pulled upward by rotation about the shaft 10 shown in FIG. 1, opening the banknote insertion opening 13, as shown in FIG. 3. Open spaces are formed below and on the sides of the upper chute 8 at this time and, it is possible to use these spaces to operate the banknote conveying path width changing means 21 so as to change the width of the banknote conveying path 12.

That is, the entire arm supporting the sheet plate 23 is rotated toward the outside of the upper chute 8, with one end 22*a* of the arm 22 and the other end 22*b*, which is shown in FIG. 1 acting, as the pivots, as indicated by arrow B in FIG. 3.

Figure 4:
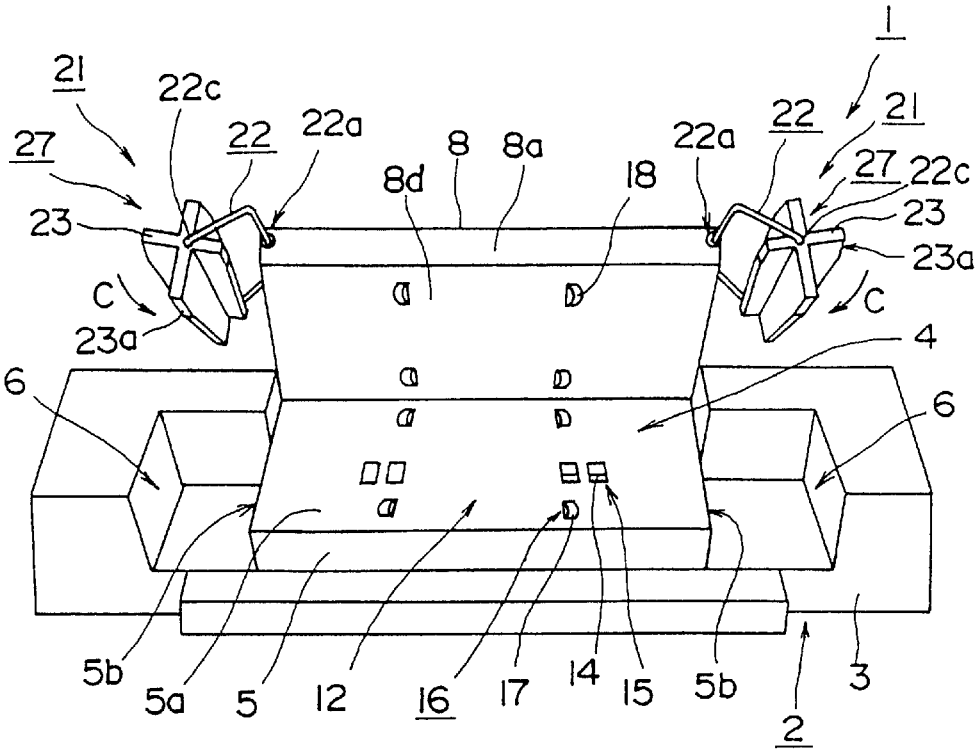
FIG. 4 is a schematic perspective view showing the operation of the banknote conveying path width varying means in which the arm is rotated outward about the ends thereof.

Next, as indicated by arrow C in FIG. 4, at the position, where the sheet plate 23 stops, the 4 sheet plates 23 are rotated around the intermediate portion 22*c* of the arm 22 until another, different width sheet plate 23 is reached.

Then, once the other, different width sheet plate 23 has reached the above-described position, the entire arm supporting the sheet plate 23 is rotated toward the inside of the upper chute 8, having the one end 22*a* of the arm 22 and the other end 22*b*, which is shown in FIG. 1, as the pivot, until the intermediate portion 22*c* of the arm 22 is horizontal to the banknote conveying path 12.

Figure 5:
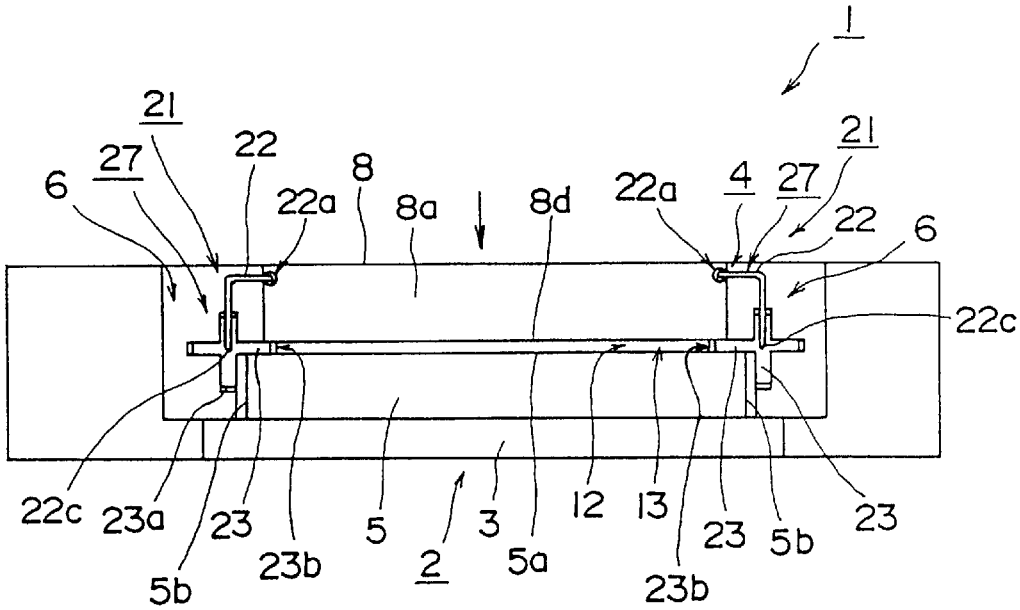
FIG. 5 is a schematic front view showing banknote conveying path width varying means after the width of the banknote conveying path has been changed.

Following this, the upper chute 8 is moved downward by rotating it around the shaft 10, and the latch means is mated, enabling the banknote conveying path width to be changed, as shown in FIG. 5.

Furthermore, by utilizing the space formed below the upper chute 8, it is possible to replace the conveying means 16 and clean the identifying means 15 shown in FIG. 3.

In this way, with the banknote processing apparatus 1 of this invention, the banknote conveying path width changing means 21 comprises arm 22, which is provided parallel to the direction of travel of the banknote, and both ends 22*a*, 22*b* of which are supported in a freely rotatable manner by the side of the upper chute 8, and a guide rotor 27, which is supported in a freely rotatable manner by the intermediate portion 22*c* of the arm 22, paralleling the direction of travel of the banknote, and which is formed from four sheet plates 23 radially provided and having different widths and running parallel to the direction of travel of the banknote. When one of the plurality of sheet plates 23 of the guide roller 27 is provided between the upper and lower chutes 8, 2, because the side 23*b* of the sheet plate 23 serves to form the side of the banknote conveying path 12, it is possible to change the banknote conveying path width of the sheet guide 1 using a simple operation, without having to perform the complicated job of preparing and inserting a mating member with a shape corresponding to the width of the banknote to be conveyed as in the past when changing the banknote conveying path width of the sheet guide 1.

Furthermore, with the banknote processing apparatus 1, because a banknote conveying path width changing means 21 is provided on the right side and the left side of the upper chute 8, respectively, and because the banknote conveying path width changing means 21 each constitute a guide rotor 27 comprising four sheet plates 23, it is possible to select from among the four sheet plates 23 constituting each guide rotor 27, respectively, a right and left sheet plate 23 to be provided between the upper and lower chutes 8, 2. This enables the width of the banknote conveying path to be changed to several types.

Therefore, if right and left sheet plates 23 that accord with the bill width of a banknote are respectively selected, and provided between the upper chute 8 and the lower chute 2, it is possible to provide a banknote conveying path 12, which has a banknote conveying path width that accords with the bill width of the banknote.

That is, in accordance with the sheet guide 1, it is possible to easily change to a banknote conveying path width, which corresponds to the different widths of banknotes various countries around the globe, by using only members provided inside the apparatus.

Further, with the sheet guide 1 of this embodiment, the upper chute 8 is supported by a shaft 10 in a freely rotatable manner relative to the lower chute 2, and when the upper chute 8 rotates via the shaft 10 to a prescribed angle relative to the lower chute 2, because it provides a not-shown positioning means, which maintains this state, the open space of the banknote conveying path width changing means 21, which is formed below and on the sides of the upper shoot 8, can be easily maintained, enabling the arm 22 and sheet plate 23 to be rotated more easily.

Furthermore, with the sheet guide 1 of this embodiment, banknote conveying path width changing means 21, which change in a plurality of stages the width of the banknote conveying path, are provided on both sides of the upper chute 8, but the present invention is not limited to this, and the sheet guide 1 can provide a banknote conveying path width changing means 21 to one side of at least one chute from among the upper and lower chutes 8, 2. For example, a single banknote conveying path width changing means 21, which corresponds to the widths of a banknote, can be provided on the right side of the lower chute 2.

Further, with the sheet guide 1 of this embodiment, banknote conveying path width changing means 21 with the same structure are provided on the right side and left side of the upper chute 8, but the present invention is not limited to this, and the right side banknote conveying path width changing means 21 and the left side banknote conveying path width changing means 21 can be constructed so that the sheet plates 23 of the guide rotors 27 thereof have widths that differ from one another.

Further, with the sheet guide 1 of this embodiment, banknote conveying path width changing means 21 constitute four sheet plates 23, which have different widths, but the present invention is not limited to this, and it can be constructed from a plurality of sheet plates 23, which have different widths. For example, the present invention can also constitute two sheet plates.

Furthermore, with the sheet material guide 1 of this embodiment, because banknote conveying path width changing means 21, which comprise an arm 22, are attached in a freely detachable manner to the upper chute 8, banknote conveying path width changing means 21 can readily be changed to banknote conveying path width changing means 21, for which the sheet plates 23 of the guide rotor 27 thereof have widths that differ from one another, and banknote conveying path width changing means 21 comprising four sheet plates 23 can be easily changed to banknote conveying path width changing means 21 comprising two sheet plates 23.

Further, with the sheet guide 1 of this embodiment, an inclined surface 23*a,* which increases the width of the banknote conveying path 12 toward the banknote insertion opening 13, is formed on each of the four sheet plates 23, but the present invention is not limited to this, and, for example, it can also constitute sheet plates, for which the inclined surface 23*a* is not formed.

INDUSTRIAL APPLICABILITY

As described above, a sheet guide according to the present invention is useful as a guide, which guides a banknote into a banknote processing apparatus, which is utilized in such service equipment as a vending machine, a money changing machine, a pinball dispenser on a medal dispenser, and more particularly, is well suited for use as a sheet guide, which is capable of easily changing the banknote conveying path width in accordance with banknotes from various countries around the world, the widths of which differ.

What is claimed is:

1. A sheet guide having a sheet conveying path (12), upper and lower surfaces thereof being formed by a lower chute (2) and an upper chute (8); a sheet insertion opening (13) which communicates with the sheet conveying path (12); and a sheet conveying path width varying means (21) disposed on a side of at least one of the upper and lower chutes (8 or 2), for changing a width of the sheet conveying path (12) in a plurality of stages, characterized in that the sheet conveying path width varying means comprises:

an arm (22) disposed parallel to a direction of travel of a sheet, both ends thereof (22*a,* 22*b*) being supported in a freely rotatable manner at a side portion of one of the chutes (8 or 2); and a guide rotor (27) supported in a freely rotatable manner by an intermediate portion (22*c*) of the arm (22), the intermediate portion (22*c*) paralleling the direction of travel of the sheet, and formed with a plurality of sheet plates (23) radially disposed with differing widths that parallel the direction of travel of the sheet, wherein when one of the plurality of sheet plates (23) of the guide rotor (27) is disposed between the upper and lower chutes (8, 2), a side edge (23*b*) of the sheet plate (23) forms a side of the sheet conveying path (12).

2. The sheet guide according to claim 1, wherein each of the plurality of sheet plates (23) of the guide rotor (27) are formed with inclined surfaces (23*a*) on the side edges(23*b*) thereof, which increases a width of the sheet conveying path (12) towards the sheet material insertion opening (13).

3. The sheet guide according to claim 1, wherein the upper chute (8) is supported by the lower chute (2) in a freely rotatable manner at a downstream portion of the sheet conveying path (12).

4. The sheet guide according to claim 1, wherein the guide rotor (27) comprises four sheet plates (23).

5. The sheet guide according to claim 1, wherein the sheet conveying path width varying means (21) are disposed on both sides of one of the chutes (8 or 2).

6. The sheet guide according to claim 5, wherein the sheet conveying path width varying means (21) both have the same structure.

7. The sheet guide according to claim 5, wherein the sheet plates (23) of the sheet conveying path width varying means (21) disposed on one side have a width differing from a width of the sheet plates (23) disposed on a second side of one of the chutes (8 or 2).

* * * * *